US012774613B2

(12) United States Patent
Ma

(10) Patent No.: US 12,774,613 B2
(45) Date of Patent: Oct. 27, 2026

(54) APPARATUS FOR CLEANING POOL AND CONTROLLING METHOD

(71) Applicant: AIPER GLOBAL PTE. LTD., Singapore (SG)

(72) Inventor: Yu Ma, Shenzhen (CN)

(73) Assignee: AIPER GLOBAL PTE. LTD., Singapore (SG)

( * ) Notice: Subject to any disclaimer, the term of this patent is extended or adjusted under 35 U.S.C. 154(b) by 0 days.

(21) Appl. No.: 19/234,860

(22) Filed: Jun. 11, 2025

(65) Prior Publication Data

US 2026/0085538 A1 Mar. 26, 2026

Related U.S. Application Data

(63) Continuation of application No. 19/189,716, filed on Apr. 25, 2025, now abandoned.

(30) Foreign Application Priority Data

Sep. 23, 2024 (CN) ..... 202411323373.2

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/00
USPC ..... 4/492, 490; 210/167.1, 167.2
See application file for complete search history.

(56) References Cited

U.S. PATENT DOCUMENTS 11,803,193 B1 * 10/2023 Zhao ..... G05D 1/0206

FOREIGN PATENT DOCUMENTS

| | | | | |
|---|---|---|---|---|
| CN | 120628054 A | * | 9/2025 | ..... G01C 21/3807 |
| CN | 120704342 A | * | 9/2025 | ..... E04H 4/1654 |
| EP | 4647863 A1 | * | 11/2025 | ..... G05D 1/622 |
| WO | WO-2025199896 A1 | * | 10/2025 | ..... G05D 1/648 |

* cited by examiner

*Primary Examiner* — Lori L Baker
(74) *Attorney, Agent, or Firm* — David D. Brush; Westman, Champlin & Koehler, P.A.

(57) ABSTRACT

A pool cleaning apparatus and a control method for the pool cleaning apparatus. The control method may include: determining real-time positioning information of an obstacle of wire harness type in a pool based on real-time sensed data about obstacles in front of the pool cleaning apparatus in the pool; determining, in real time and at a predetermined time interval, an obstacle avoidance route allowing the pool cleaning apparatus to bypass the obstacle of wire harness type, based on the real-time positioning information of the obstacle of wire harness type in the pool and map data about at least a part of the pool; and controlling the pool cleaning apparatus to move in the pool in a new time period with a duration corresponding to the predetermined time interval, based on the obstacle avoidance route determined in real time.

19 Claims, 4 Drawing Sheets

APPARATUS FOR CLEANING POOL AND CONTROLLING METHOD

CROSS-REFERENCE

The present disclosure claims a benefit of, and priority to Chinese Patent Application No. 202411323373.2 filed on Sep. 23, 2024, the disclosure of which is hereby expressly incorporated by reference herein in its entirety.

TECHNICAL FIELD

The present disclosure relates to an apparatus for cleaning a pool and a method for controlling the apparatus.

BACKGROUND

For pool facilities such as swimming pools, a pool cleaning apparatus may be utilized for automatic cleaning or auxiliary cleaning. For example, the pool cleaning apparatus may be configured to move, for example through electricity, on the bottom, walls (or side walls or side elevations) and/or water surface of the pool, while having its cleaning mechanism (such as a roller brush) operated, for example to clean dirt, to filter pool water, to absorb dirt, and so on.

SUMMARY

In an aspect, disclosed is a control method for a pool cleaning apparatus. The control method may include: determining real-time positioning information of an obstacle of wire harness type (or a wire harness obstacle) in a pool based on real-time sensed data about obstacles in front of the pool cleaning apparatus in the pool; determining, in real time and at a predetermined time interval, an obstacle avoidance route allowing the pool cleaning apparatus to bypass the obstacle of wire harness type, based on the real-time positioning information of the obstacle of wire harness type in the pool and map data about at least a part of the pool; and controlling the pool cleaning apparatus to move in the pool in a new time period with a duration corresponding to the predetermined time interval, based on the obstacle avoidance route determined in real time.

In one or more embodiments of the control method, the predetermined time interval may be greater than or equal to 50 milliseconds and may be less than or equal to 300 milliseconds.

In one or more embodiments of the control method, the obstacle avoidance route may further depend on a height of the pool cleaning apparatus.

In one or more embodiments, the control method may further include updating the real-time positioning information of the obstacle of wire harness type in the pool into the map data.

In one or more embodiments of the control method, at least a part of the obstacle avoidance route may be along an edge of a shape of the obstacle of wire harness type or an edge of a bounding box of the obstacle of wire harness type.

In one or more embodiments, the control method may further include obtaining the real-time sensed data through at least one lidar and/or at least one camera of the pool cleaning apparatus.

In one or more embodiments, the control method may further include recognizing the obstacle of wire harness type among the obstacles according to the real-time sensed data.

In one or more embodiments, the control method may further include: determining a moving route of the pool cleaning apparatus in the pool based on map data about at least a part of the pool, in the case of a failed detection of the obstacle of wire harness type according to the real-time sensed data; and controlling the pool cleaning apparatus to move in the pool based on the determined moving route.

In another aspect, disclosed is a pool cleaning apparatus. The pool cleaning apparatus may include: at least one sensor configured to obtain real-time sensed data about obstacles in front of the pool cleaning apparatus in a pool; and a controller configured to execute the control method as described above.

In one or more embodiments, the at least one sensor may include at least one lidar and/or at least one camera.

DETAILED DESCRIPTION

Figure 1:
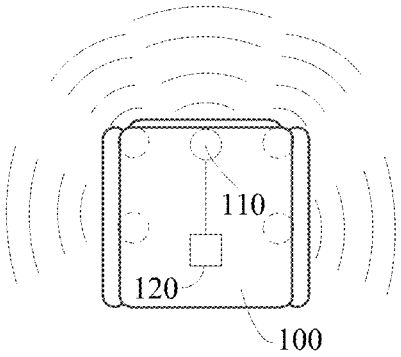
FIG. 1 schematically shows an example of a pool cleaning apparatus in an embodiment.

Embodiments of the present disclosure will be described hereinafter in detail with reference to accompany drawings. In the drawings, the same reference numbers will be assigned to the same or equivalent parts for which descriptions will not be repeated.

A pool cleaning apparatus (hereinafter also referred to as a "cleaning apparatus") in an embodiment may be configured with a moving mechanism. For example, the moving mechanism of the pool cleaning apparatus may include one or more parts such as a driving motor, moving tracks and/or moving wheels. For example, the driving motor may work by electricity and may drive the moving tracks and/or moving wheels of the pool cleaning apparatus to operate according to control instructions, so that the pool cleaning apparatus may, for example, move or change its posture (for example, rotate) in one or more areas such as the bottom or wall of the pool.

In some embodiments, a buoyancy control mechanism may also be provided in the pool cleaning apparatus. For example, the buoyancy control mechanism may include one or more parts such as a gas bag, a gas chamber and/or a gas pump. For example, the buoyancy control mechanism may work by electricity and may control content of gas in the gas bag and/or gas chamber through the gas pump, so that a volume of the gas bag and in turn a buoyancy of the pool cleaning apparatus in the water of the pool may be adjusted. Thus, the pool cleaning apparatus may be enabled to directly float to the surface of the water or dive to the bottom of the pool by changing the buoyancy, or to be at a specified height in the water of the pool by keeping a certain buoyancy. For example, the pool cleaning apparatus may move (for example, swim on the water surface) or change its posture in one or more areas such as the pool bottom, the pool wall and the water surface in the pool through a cooperation of the moving mechanism and the buoyancy control mechanism.

The wording "on the water surface" herein may include, but is not limited to, a case where at least one part of the pool cleaning apparatus is located or submerged below the water surface, while the other part is above the water surface, or is level or substantially level with the water surface, which, for example, may be occasionally or always covered or submerged by the water surface.

In some embodiments, one or more sprays may be further configured at atop of the pool cleaning apparatus opposite to a chassis (i.e., the bottom surface of the apparatus which is the closest to the bottom of the pool when the pool cleaning apparatus moves on the bottom) or at another one or more suitable positions of the pool cleaning apparatus, and the pool cleaning apparatus may be configured to spout at least a part of water, which enters the pool cleaning apparatus from the pool, to the outside of the pool cleaning apparatus from at least one spray according to instructions, for example by a water pump in the pool cleaning apparatus. For example, at least a part of water in the pool cleaning apparatus may be spouted from at least one spray when the pool cleaning apparatus is located on the pool wall, so that a pressure of the pool cleaning apparatus on the pool wall may be increased and the pool cleaning apparatus may be enabled to crawl on the pool wall.

The pool cleaning apparatus may also be configured with a cleaning mechanism. For example, the cleaning mechanism of the pool cleaning apparatus may include one or more parts such as a water suction port for absorbing dirt or debris and water in the pool into the pool cleaning apparatus, a roller brush for scrubbing the contacted pool bottom or pool wall, a filter for filtering the absorbed water, a water outlet for discharging the filtered water, and the like.

For example, the cleaning mechanism may start to work after entering the water, and may work continuously or intermittently while moving or staying in any area in the pool. Thus, for example, dirt or debris in the pool may be absorbed into the pool cleaning apparatus from the water suction port together with the water in the pool, for example by the water pump and other parts in the pool cleaning apparatus. Then, for example, the water and dirt or debris absorbed into the pool cleaning apparatus may be pumped into or through the filter by the water pump and other parts in the pool cleaning apparatus, so that the dirt or debris in the water may be intercepted or adsorbed by the filter, and the filtered water may be discharged into the pool from the water outlet by the water pump and other parts in the pool cleaning apparatus. Thus, the pool may be cleaned.

The pool cleaning apparatus may be controlled by a processor or controller in the pool cleaning apparatus to move according to a route determined by the processor or controller, and to clean the pool meanwhile. It is usually expected that the determined moving route may cover areas to be cleaned in the pool as completely as possible, and may achieve an avoidance of obstacles such as cables in the pool. Accordingly, for example, one or more sensors may be configured at one or more suitable positions in the body or on the housing of the pool cleaning apparatus for sensing obstacles in front of the pool cleaning apparatus at least in a moving direction of the pool cleaning apparatus. Then, the processor or controller in the pool cleaning apparatus may determine information about types and/or shapes (including shapes, positions, and so on) of the obstacles according to the sensed data, and then may determine a route allowing the pool cleaning apparatus to avoid (for example, bypass or pass through) an obstacle of specified type, for example, an obstacle of wire harness type (or say, a wire harness obstacle) in the pool.

As shown in FIG. 1, in an embodiment, an ultrasonic sensor 110 may be arranged at a suitable position in the body or on the housing of the pool cleaning apparatus 100. The ultrasonic sensor 110 may be configured to emit one or more ultrasonic signals in the moving direction when the pool cleaning apparatus 100 moves on the bottom of the pool or in a direction which the front of the pool cleaning apparatus 100 orients, and to receive one or more ultrasonic signals (also referred to as "one or more echo signals") reflected by obstacles in front of the pool cleaning apparatus 100, for example.

Further, as shown by dotted circles in FIG. 1, one or more another ultrasonic sensors may be configured at one or more another suitable positions in the body or on the housing of the pool cleaning apparatus 100, for transmitting and receiving ultrasonic signals in one or more another directions, so that the ultrasonic signals may cover more angles and/or directions. For example, one or more ultrasonic waves may be emitted and received in one or more directions at a predetermined angle to the direction in which the ultrasonic sensor 110 emits ultrasonic waves, which directions may either be on the moving plane of the pool cleaning apparatus 100 or not, and/or in a direction which the left and/or right sides of the pool cleaning apparatus 100 orient, and/or in a direction which the lower and/or rear parts of the pool cleaning apparatus 100 orient.

In a case where a plurality of ultrasonic sensors including the ultrasonic sensor 110 are configured in the pool cleaning apparatus 100, the plurality of ultrasonic sensors may be configured to transmit a plurality of ultrasonic signals in a time-sharing manner, so that mutual interference of the plurality of transmitted ultrasonic signals may be avoided.

The processor or controller 120 in the pool cleaning apparatus 100 may be configured to determine information about obstacles in front of the pool cleaning apparatus 100 according to sensed data from at least one ultrasonic sensor including the ultrasonic sensor 110. The processor or controller 120 may include a central processing unit (CPU), a graphics processing unit (GPU) or other types or forms of processing units with data processing capability and/or instruction execution capability.

For example, based on the sensed data from a single ultrasonic sensor, the processor or controller 120 may determine whether there is an obstacle in front of the pool cleaning apparatus 100, as well as the current distance between the obstacle and the pool cleaning apparatus 100.

Based on the sensed data from a plurality of ultrasonic sensors, in connection with the relative position relationship among the plurality of ultrasonic sensors and so on, the processor or controller 120 may further determine a category of a surface shape of the obstacle in front of the pool cleaning apparatus 100 and two-dimensional position information of the obstacle on the same plane as the moving plane of the pool cleaning apparatus 100. For example, based on the sensed data of the plurality of ultrasonic sensors, in connection with the relative position relationship among the plurality of ultrasonic sensors and so on, the processor or controller 120 may identify or recognize whether the obstacle is in a form of for example a point or a column or a wire harness or a wall or other form, by methods such as an object shape identification based on ultrasonic ranging and an object shape identification based on echo frequency.

Figure 2:
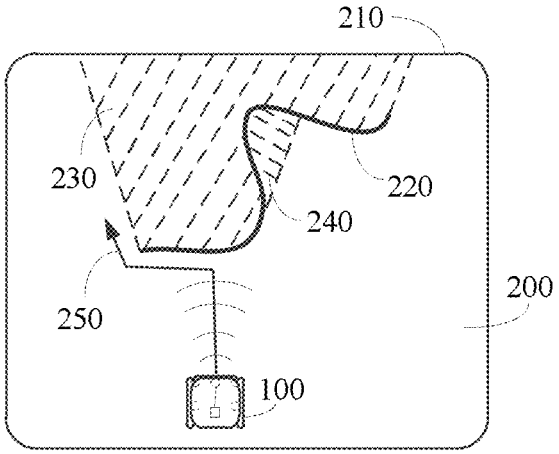
FIG. 2 schematically shows an example of controlling a pool cleaning apparatus to avoid obstacles in a pool in an embodiment.

As shown in FIG. 2, the pool cleaning apparatus 100 may sense obstacles in front of the pool cleaning apparatus 100 in the moving direction of the pool cleaning apparatus 100 or in the direction which the front of the pool cleaning apparatus 100 orients, by at least one sensor including the ultrasonic sensor 110.

The processor or controller 120 in the pool cleaning apparatus 100 may determine a shape and type of an obstacle in front of the pool cleaning apparatus 100, and position information of a boundary of the obstacle on a plane corresponding to the bottom of the pool 200 where the pool cleaning apparatus 100 is currently located, based on sensed data from at least one sensor including the ultrasonic sensor 110. For example, position information, such as a set of plane coordinates or a boundary line equation, may be determined for a plurality of points representing the obstacle or a bounding box or boundary envelope of the obstacle on the plane corresponding to the bottom of the pool 200 where the pool cleaning apparatus 100 is currently located. For example, the sensed obstacles may include an obstacle of wall type like the wall 210 of the pool 200, and an obstacle 220 of wire harness type.

Then, the processor or controller 120 may determine an obstacle avoidance route 250 that enables the pool cleaning apparatus 100 to move at the bottom of the pool 200 and to avoid the obstacle 220 in front of the pool cleaning apparatus 100, based on map information about at least a part of the pool 200 and the position information of the obstacle 220, and may control the pool cleaning apparatus 100 to move at the bottom of the pool 200 according to the determined obstacle avoidance route 250. The map information about at least a part of the pool 200 may be obtained for example by lateral ultrasonic edge detection or Simultaneous Localization and Mapping (SLAM).

As described above, by a single ultrasonic sensor 110, it may be judged whether there is an obstacle in front of the pool cleaning apparatus 100, and the current distance between the obstacle and the pool cleaning apparatus 100 may also be determined. A plurality of ultrasonic sensors may be configured in the pool cleaning apparatus 100 so that the type of the surface shape of the obstacle in front of the pool cleaning apparatus 100 and the two-dimensional position information of the obstacle on the same plane as the moving plane of the pool cleaning apparatus 100 may be further determined.

As shown in FIG. 2, for example due to limitations in terms of number and angle of the ultrasonic sensors in the pool cleaning apparatus 100, there may be blind areas such as areas 230 and 240, resulting in that the route 250 fails to cover the whole cleaning area. In addition, for small or complicated obstacles such as small or complicated obstacles of wire harnesses type, or in the case of poor water quality or many bubbles in the pool 200, an accuracy of obstacles sensing based on the ultrasonic sensors may be affected, which may also lead to a quality decline of the route 250 and further a decline of cleaning coverage.

Figure 3:
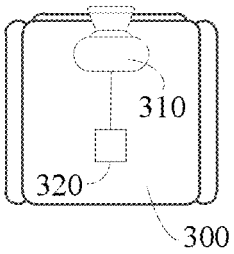
FIG. 3 schematically shows an example of a pool cleaning apparatus in an embodiment.

In another embodiment, as shown in FIG. 3, at least one image sensor or camera 310 may be configured at any one or more suitable positions in the body or on the housing of the pool cleaning apparatus 300, in addition to or in lieu of the ultrasonic sensor 110. The image sensor or camera 310 may be configured to acquire one or more real-time images about a scene in front of the pool cleaning apparatus 300 (for example, in front of the moving direction in which the pool cleaning apparatus 300 moves on the bottom of the pool or in a direction which the front of the pool cleaning apparatus 300 faces) at a predetermined sampling frequency. The one or more real-time images may include one or more static images and/or one or more dynamic images.

The processor or controller 320 in the pool cleaning apparatus 300 may receive one or more real-time images from the image sensor or camera 310, recognize or identify an obstacle of a specified type (for example, an obstacle of wire harness type) in front of the pool cleaning apparatus 300 based on the received one or more real-time images, and determine real-time position information of the identified obstacle of specified type in the pool. Then, the processor or controller 320 may determine an obstacle avoidance route that allows the pool cleaning apparatus 300 to bypass the identified obstacle, based on the real-time position information of the obstacle and map data about at least a part of the pool, wherein the map data may be obtained at any suitable time by any suitable method such as lateral ultrasonic edge detection or SLAM. Then, the processor or controller 320 may control the pool cleaning apparatus 300 to move in the pool according to the determined obstacle avoidance route.

In the embodiment, the processor or controller 320 may perform any suitable processing on the received one or more real-time images according to predetermined program instructions, and may identify the obstacle of specified type from the one or more real-time images and determine the real-time position of the obstacle in the pool by any suitable method. For example, the processor or controller 320 may perform processing, such as scaling, morphing, and stitching, on the received one or more real-time images. For example, the processor or controller 320 may utilize a pre-trained image convolution neural network model or other suitable image processing model to process the received one or more real-time images, to obtain the real-time position of the obstacle of specified type (for example, the obstacle of wire harness type) in the pool, for example, spatial coordinates representing a plurality of points of the obstacle in a space corresponding to the pool.

In addition, in the embodiment, the processor or controller 320 may determine an obstacle avoidance route allowing the pool cleaning apparatus 300 to avoid the obstacle of specified type while ensuring a sufficient cleaning coverage (for example, reaching above a predetermined cleaning coverage threshold), based on the determined real-time location information of the obstacle of specified type in the pool and the map data about at least a part of the pool. For example, the processor or controller 320 may add data about the obstacle of specified type into the map data about at least a part of the pool according to the determined real-time position information of the obstacle of specified type in the pool, and then determine, according to the updated map data, the obstacle avoidance route enabling the pool cleaning apparatus 300 to bypass the obstacle of specified type while ensuring sufficient cleaning coverage.

Like the processor or controller 120, the processor or controller 320 may include a CPU, a GPU, or other types or forms of processing units with data processing capability and/or instruction execution capability. For example, in the case of processing the received one or more real-time images by a pre-trained image convolution neural network model, the processor or controller 320 may also include a circuit for accelerating convolution operation, such as a multiply-add array, or may include a circuit device or chip, such as a brain processor (BPU), which may be more suitable for operation and processing in a convolution neural network.

Figure 4:
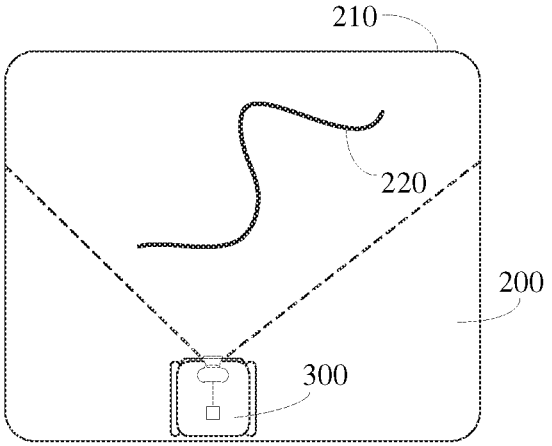
FIG. 4 schematically shows an example of controlling a pool cleaning apparatus to avoid obstacles in a pool in an embodiment.
Figure 5:
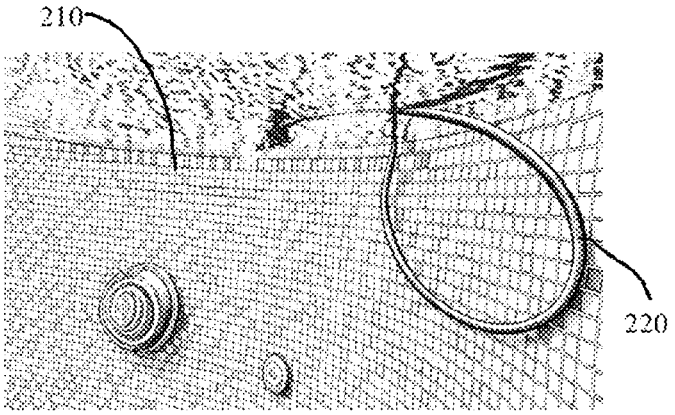
FIG. 5 shows a fragmentary view of an example of an obstacle in a pool in an embodiment.

For example, as shown in FIG. 4, after the pool cleaning apparatus 300 enters the pool 200, or during a movement of the pool cleaning apparatus 300 in the pool 200 (for example at the bottom of the pool 200), the pool cleaning apparatus 300 may obtain, by the image sensor or camera 310, one or more real-time images about a scene in front of the pool cleaning apparatus 300, such as the scene in the field of vision between two dashed lines drawn from the pool cleaning apparatus 300 in FIG. 4. An example of an obtained real-time image is shown in FIG. 5, which includes a wall 210 (an obstacle of wall type) and an obstacle 220 (an obstacle of wire harness type) in front of the pool cleaning apparatus 300 currently.

Then, the processor or controller 320 of the pool cleaning apparatus 300 may process and analyze the obtained one or more real-time image for example by a pre-trained image convolution neural network model, to identify or recognize a specified type of obstacle, such as the obstacle 220 of wire harness type, and to determine a real-time position of the obstacle 220 in the pool 200, such as three-dimensional coordinates for representing a plurality of points of the obstacle 220 in the space corresponding to the pool 200.

Then, the processor or controller 320 may determine an obstacle avoidance route for the pool cleaning apparatus 300 to bypass the obstacle 220 according to the determined real-time position information of the obstacle 220 in the pool 200 and the map data about at least a part of the pool 200 for example by a pre-trained image convolution neural network model or any other suitable image processing model or route planning model based on artificial intelligence or deep learning, wherein the map data may be obtained for example at any suitable time by any suitable method such as lateral ultrasonic edge detection or SLAM.

Figure 6:
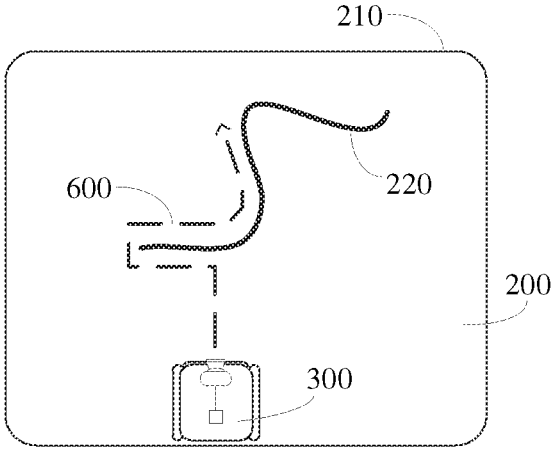
FIG. 6 schematically shows an example of controlling a pool cleaning apparatus to avoid obstacles in the pool in an embodiment.

For example, as shown in FIG. 6, the processor or controller 320 may determine an obstacle avoidance route 600 that allows the pool cleaning apparatus 300 to bypass the obstacle 220, wherein at least a part of the obstacle avoidance route 600 may extend along the edge or contour of the shape of the obstacle 220.

Figure 7:
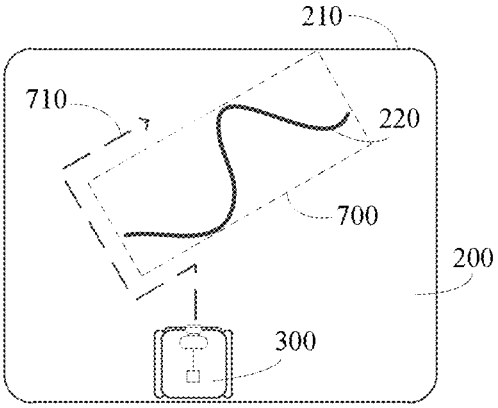
FIG. 7 schematically shows an example of controlling a pool cleaning apparatus to avoid obstacles in a pool in an embodiment.

As shown in FIG. 7, the processor or controller 320 may also determine a bounding box 700 of the obstacle 220, and then determine an obstacle avoidance route 710 for the pool cleaning apparatus 300 to bypass the bounding box 700, wherein at least a part of the obstacle avoidance route 710 extends along the edge or contour of the bounding box 700. In this example, the bounding box 700 is a directional bounding box. In another implementation, other types of bounding box, such as a bounding ball, an axis-aligned bounding box, and a fixed pattern package, may also be used.

Figure 8:
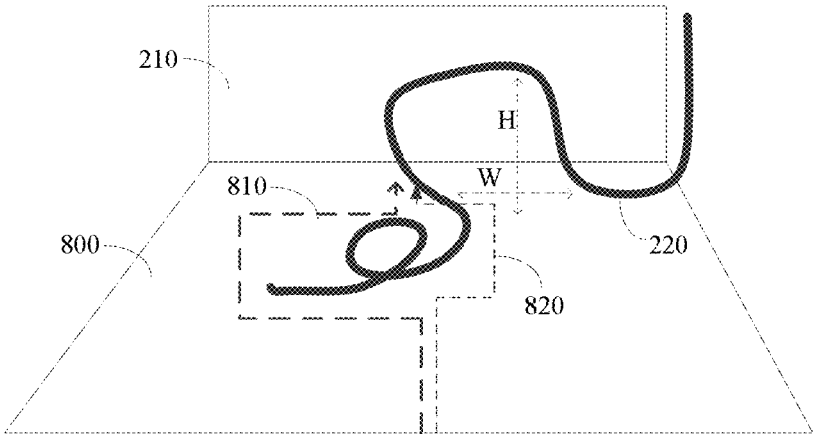
FIG. 8 schematically shows an example of controlling a pool cleaning apparatus to avoid obstacles in the pool in an embodiment.

In addition, as shown in FIG. 8, in a case where a part of the obstacle 220 is recognized as suspending in the pool 200 for example by the image convolution neural network model or other suitable image processing model based on artificial intelligence or deep learning, or based on the real-time positioning information (for example, multiple three-dimensional coordinates) of the obstacle 220, the processor or controller 320 may further determine whether a gap with height H and width W formed between the suspending part of the obstacle 220 in the pool 200 and the bottom 800 of the pool 200 allows the pool cleaning apparatus 300 to pass through, according to the real-time positioning information of the obstacle 220 and a physical size of the pool cleaning apparatus 300 such as the height and/or width of the pool cleaning apparatus 300.

For example, in a case where the gap is insufficient for the pool cleaning apparatus 300 to pass through, the processor or controller 320 may determine an obstacle avoidance route 810 so that the pool cleaning apparatus 300 may bypass the obstacle 220. In a case where the gap is sufficient for the pool cleaning apparatus 300 to pass through, the processor or controller 320 may determine either an obstacle avoidance route 810 so that the pool cleaning apparatus 300 may bypass the obstacle 220, or an obstacle avoidance route 820 so that the pool cleaning apparatus 300 may bypass the obstacle 220 by passing through the gap.

The pool cleaning apparatus 300 obtains one or more real-time images about the scene in front of the pool cleaning apparatus 300 by the image sensor or camera 310, identifies a specified type of obstacle (for example, an obstacle of wire harness type) in the pool based on the obtained one or more real-time images, and determines the real-time positioning information of the identified specified type of obstacle in the pool, and then determines, according to the determined real-time position information of the specified type of obstacle in the pool and the map data about at least a part of the pool, an obstacle avoidance route allowing the pool cleaning apparatus 300 to bypass the specified type of obstacle. Thus, obstacles may be sensed and positioned by fewer sensors than implementations utilizing ultrasonic sensors in the examples of FIGS. 1 and 2. In addition, by configuring the image sensor or camera 310 and utilizing the image processing technology, the obstacle of wire harness type, which may be small and complicated, may be identified or recognized more accurately and stably under different light and water quality conditions, so that a quality deterioration of the planned route quality and further a reduction of the cleaning coverage rate, for example due to a poor water quality in the pool 200 or an existence of a large number of bubbles in the pool 200, may be at least partially alleviated.

Figure 9:
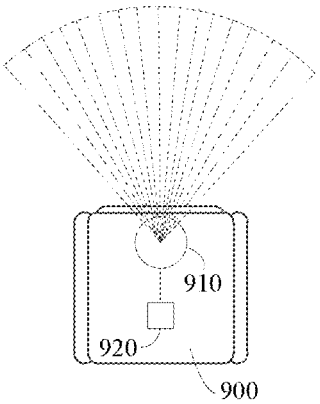
FIG. 9 schematically shows an example of a pool cleaning apparatus in an embodiment.

In another embodiment, as shown in FIG. 9, at least one laser radar or lidar 910 may be configured at a suitable position in the body or on the housing of the pool cleaning apparatus 900, in addition to or in lieu of the ultrasonic sensor 110 and/or the image sensor or camera 310. The lidar 910 may be configured to acquire point cloud data or point cloud images at least about the scene in front of the pool cleaning apparatus 900 (for example, in a forward direction when the pool cleaning apparatus 900 moves on the bottom or in a direction which the front of the pool cleaning apparatus 900 faces) at a predetermined sampling frequency. For example, the lidar 910 may be configured to acquire real-time point cloud data or point cloud images about the scene around the pool cleaning apparatus 900 at a predetermined sampling frequency.

The processor or controller 920 in the pool cleaning apparatus 900 may receive real-time point cloud data or point cloud images from the lidar 910, identify an obstacle of specified type (such as an obstacle of wire harness type) in front of the pool cleaning apparatus 900 based on the received real-time point cloud data or point cloud images, and determine the real-time position information of the identified obstacle of specified type in the pool. Then, the processor or controller 920 may determine an obstacle avoidance route that allows the pool cleaning apparatus 900 to bypass the identified obstacle according to the real-time position information of the obstacle and the map data about at least a part of the pool, and control the pool cleaning apparatus 900 to move in the pool according to the determined obstacle avoidance route.

In this embodiment, the processor or controller 920 may adopt any suitable method to identify the obstacle of specified type and to determine the real-time position of the obstacle in the pool according to the received real-time point cloud data or point cloud images. For example, the processor or controller 920 may process the received real-time point cloud data or point cloud images by a pre-trained image convolution neural network model or other suitable image processing models, to obtain the real-time position of the obstacle of specified type (for example, the obstacle of wire harness type) in the pool, for example the spatial coordinates representing a plurality of points of the obstacle in the space corresponding to the pool.

In addition, in this embodiment, the processor or controller 920 may determine an obstacle avoidance route allowing the pool cleaning apparatus 900 to avoid the obstacle of specified type while ensuring a sufficient cleaning coverage (for example, reaching above a predetermined cleaning coverage threshold), based on the determined real-time location information of the obstacle of specified type in the pool and the map data about at least a part of the pool. For example, the processor or controller 920 may add data about the obstacle of specified type into the map data about at least a part of the pool according to the determined real-time position information of the obstacle of specified type in the pool, and then determine, according to the updated map data, the obstacle avoidance route enabling the pool cleaning apparatus 900 to bypass the obstacle of specified type while ensuring sufficient cleaning coverage.

Like the processor or controller 120 or 320, the processor or controller 920 may include a CPU, a GPU, or other types or forms of processing units with data processing capability and/or instruction execution capability. For example, in the case of processing the received real-time point cloud data or point cloud images by a pre-trained image convolution neural network model, the processor or controller 920 may also include a circuit for accelerating convolution operation, such as a multiply-add array, or may include a circuit device or chip, such as a BPU, which is more suitable for operation and processing in the convolution neural network.

It is appreciated that the present disclosure is not limited to any of the above examples.

In another embodiment, one or more sensors which may be configured in the body or on the housing of the pool cleaning apparatus may include, but are not limited to, one or more of: at least one ultrasonic sensor such as the ultrasonic sensor 210; at least one image sensor or camera such as the image sensor or camera 310; and at least one lidar such as the lidar 910. Then, the processor or controller in the pool cleaning apparatus may determine the real-time positioning information of specified type of obstacle (such as the obstacle of wire harness type) in front of the pool cleaning apparatus according to the real-time sensed data from the one or more configured sensors. Then, the processor or controller in the pool cleaning apparatus may determine an obstacle avoidance route that allows the pool cleaning apparatus to bypass the specified type of obstacle in the pool according to the determined real-time positioning information of the obstacle of specified type in front and the map data about at least a part of the pool.

In addition, in the above example, the pool cleaning apparatus 100 or 300 moves at the bottom of the pool 200, and the planned route 250, 600, 710, 810 or 820 is an obstacle avoidance route to control the pool cleaning apparatus 100 or 300 to move at the bottom of the pool 200 and bypass the obstacle 220. In another example, real-time positioning information about a specified type of obstacle (for example, an obstacle of wire harness type) in front of the pool cleaning apparatus in the moving direction may also be obtained through one or more sensors of the pool cleaning apparatus during a movement of the pool cleaning apparatus on other suitable areas (for example, a plane area) such as the wall, steps or platforms of the pool 200. The determined real-time positioning information may include, for example, but not limited to: spatial positioning information of the obstacle in the space corresponding to the pool; and/or plane positioning information of a projection of the obstacle on the plane corresponding to an area where the pool cleaning apparatus is currently located. Then, the processor or controller in the pool cleaning apparatus may determine an obstacle avoidance route that allows the pool cleaning apparatus to bypass the specified type of obstacle at least in the current area of the pool according to the determined real-time positioning information of specified type of obstacle ahead and the map data about at least a part of the pool.

In addition, in the above example, the specified type of obstacle is an obstacle of wire harness type such as the obstacle 220. In another embodiment, the obstacle of specified type may also include an obstacle of other type or shape such as point type and column type.

In addition, in various embodiments, any one or more suitable route planning algorithms, such as Dijkstra algorithm and A* algorithm, may be adopted to determine the moving route for the pool cleaning apparatus.

Usually, the closer the pool cleaning apparatus is to an obstacle, the more accurate the real-time sensed data obtained by sensors such as the ultrasonic sensor 210 and/or the image sensor or camera 310 and/or the lidar 910 in the above example. In addition, an obstacle in the pool may also be displaced with the water flow in the pool. Thus, in one or more embodiments, the processor or controller (for example, the processor or controller 120, 320 or 920 in the above examples) in the pool cleaning apparatus (for example, the pool cleaning apparatus 100, 300 or 900 in the above examples) may also update the planned obstacle avoidance route such as the obstacle avoidance route 600, 710, 810 or 820 in real time at predetermined intervals. In different embodiments, the predetermined time interval may be any suitable value according to the situations, such as 50 milliseconds to 300 milliseconds.

Figure 10:
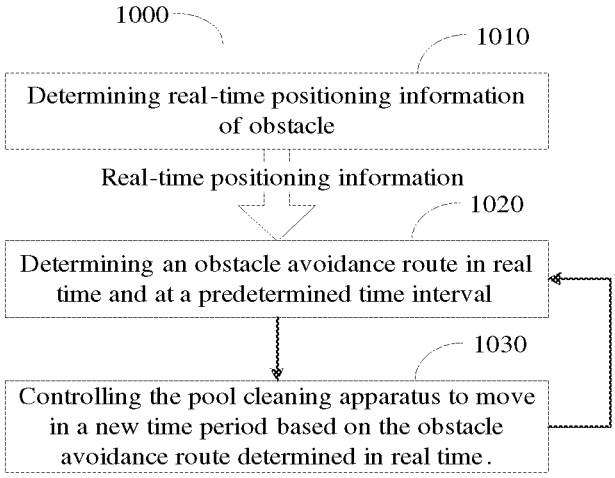
FIG. 10 shows an example of a method of controlling a pool cleaning apparatus in an embodiment.

FIG. 10 schematically illustrates an exemplary method 1000 for controlling a pool cleaning apparatus (for example, the pool cleaning apparatus 100, 300 or 900 in the above examples) in an embodiment. The processor or controller (for example, the processor or controller 120, 320 or 920 in the above examples) in the pool cleaning apparatus (for example, the pool cleaning apparatus 100, 300 or 900 in the above examples) may determine and update an obstacle avoidance route in real time by executing this method, and control a movement of the pool cleaning apparatus according to the real-time obstacle avoidance route.

As shown in FIG. 10, the exemplary method 1000 may include steps 1010, 1020 and 1030.

In the step 1010, for example, the processor or controller in the pool cleaning apparatus (for example, the processor or controller 120, 320 or 920 in the above examples) may determine the real-time positioning information of a specified type of obstacle in the pool, such as an obstacle wire harness type, based on the real-time sensed data about the obstacle in the pool in front of the pool cleaning apparatus.

For example, in the step 1010 or at least partially independent of the step 1010, information at least about obstacles in front of the pool cleaning apparatus in the pool may be continuously or periodically sensed (for example, at a predetermined sampling frequency) by at least one sensor of the pool cleaning apparatus (for example, the ultrasonic sensor 210 and/or the image sensor or camera 310 and/or the lidar 910 in the above examples), so as to obtain information about the obstacles in front of the pool cleaning apparatus in the pool.

For example, the sensor of the pool cleaning apparatus may acquire real-time sensed data about the obstacles in the pool in front of the pool cleaning apparatus according to its own sampling frequency, and update the acquired real-time sensed data to the memory in the pool cleaning apparatus, wherein the sensed data acquired in a previous sampling may be retained, or may be dropped.

Then, the processor or controller in the pool cleaning apparatus (for example, the processor or controller 120, 320 or 920 in the above examples) may identify or recognize the obstacle of specified type such as the obstacle of wear harness type among the obstacles and determine real-time positioning information of the obstacle of specified type in the pool, based on the real-time sensed data from the sensor about the obstacles in the pool in front of the pool cleaning apparatus, by any suitable processing method, such as object shape identification and location based on ultrasonic ranging and/or echo frequency, or image processing or laser point cloud image processing based on convolution neural network and/or deep learning model.

The step 1010 may be executed repeatedly according to the latest real-time sensed data in the memory at a specified frequency or a specified time interval, and the processing result, which, for example, may include information about whether there is an obstacle of specified type, the shape and positioning of the obstacle of specified type, and so on, may be updated in the memory in the pool cleaning apparatus, wherein the processing result of the previous execution of the step 1010 may be retained or not.

The execution frequency of the step 1010 may be lower than or equal to the sampling frequency of the sensor, or the execution interval of the step 1010 may be greater than or equal to the sampling time interval of the sensor. For example, the step 1010 may be performed after each sampling or every several times of sampling by the sensor, or the time interval for performing the step 1010 may be greater than or equal to the sampling time interval of the sensor, without requiring a specific proportional relationship and/or synchronous relationship with the sampling time interval of the sensor.

In the step 1020, for example, the processor or controller in the pool cleaning apparatus (for example, the processor or controller 120, 320 or 920 in the above examples) may determine an obstacle avoidance route that allows the pool cleaning apparatus to bypass the specified type of obstacle in real time at a predetermined time interval based on the real-time positioning information of the specified type of obstacle in the pool determined in the step 1010 and the map data about at least a part of the pool.

For example, the time interval in the step 1020 may be greater than or equal to 50 milliseconds and be less than or equal to 300 milliseconds, or may be another suitable value.

In an embodiment, the steps 1010 and 1020 may be controlled by the same time interval. For example, the step 1020 may be performed immediately after the step 1010. For example, the steps 1010 and 1020 may be repeatedly performed at a predetermined time interval by the processor or controller. That is, whenever the latest real-time positioning information is obtained by the step 1010, the step 1020 may be executed to determine the latest obstacle avoidance route.

In another embodiment, the time intervals in the step 1020 and the step 1020 may be different. For example, the time interval in the step 1020 may be greater than or equal to the time interval for performing the step 1020. For example, the step 1010 may be performed by a process or thread, and the step 1020 may be performed by another process or thread. For example, the processor or controller in the pool cleaning apparatus may be configured such that operations related to the step 1010 are performed by one or more processors or controller, while operations related to the step 1020 are performed by another one or more processors or controller. That is, the step 1020 may be executed in parallel with the step 1010, or the steps 1020 and 1010 may be triggered by different timers. In this embodiment, for example, in the step 1020, the latest information about the shape, location, and so on of the specified type of obstacle in front of the pool cleaning apparatus may be obtained from the memory of the pool cleaning apparatus, and then the latest (newest) obstacle avoidance route allowing the pool cleaning apparatus to bypass the specified type of obstacle may be determined based on the latest information and map data about at least a part of the pool.

In another embodiment, a part of operations in the step 1020, such as the identification of the specified type of obstacle, may also be performed in the step 1010, or independently of the steps 1010 and/or 1020.

Then, in the step 1030, for example, the processor or controller in the pool cleaning apparatus (for example, the processor or controller 120, 320 or 920 in the above examples) may control the pool cleaning apparatus to move in the pool based on the latest obstacle avoidance route determined in the step 1020, which allows the pool cleaning apparatus to bypass the specified type of obstacle, within a new time period with a duration corresponding to the execution time interval of the step 1020.

For example, a timer may be set for the steps 1020 and 1030, which may count down to 0 from a maximum time corresponding to the time interval in the step 1020 (for example, a value greater than or equal to 50 milliseconds and less than or equal to 300 milliseconds, or other suitable values), or may count to the maximum time from 0. When the timer expires, the execution of the steps 1020 and 1030 may be triggered and the timer may be reset. Thus, the steps 1020 and 1030 are repeatedly executed at a predetermined time interval, and the obstacle avoidance route may be updated in real time.

By determining the latest obstacle avoidance route in real time according to the predetermined time interval and always controlling the movement of the pool cleaning apparatus according to the latest obstacle avoidance route, a more accurate obstacle avoidance route may be determined based on more accurate real-time sensed data as much as possible, so that influences on route planning for example caused by possible a displacement of the obstacle with the water flow in the pool may be at least partially alleviated, and the cleaning coverage of the pool cleaning apparatus may be improved by providing better routes.

Figure 11:
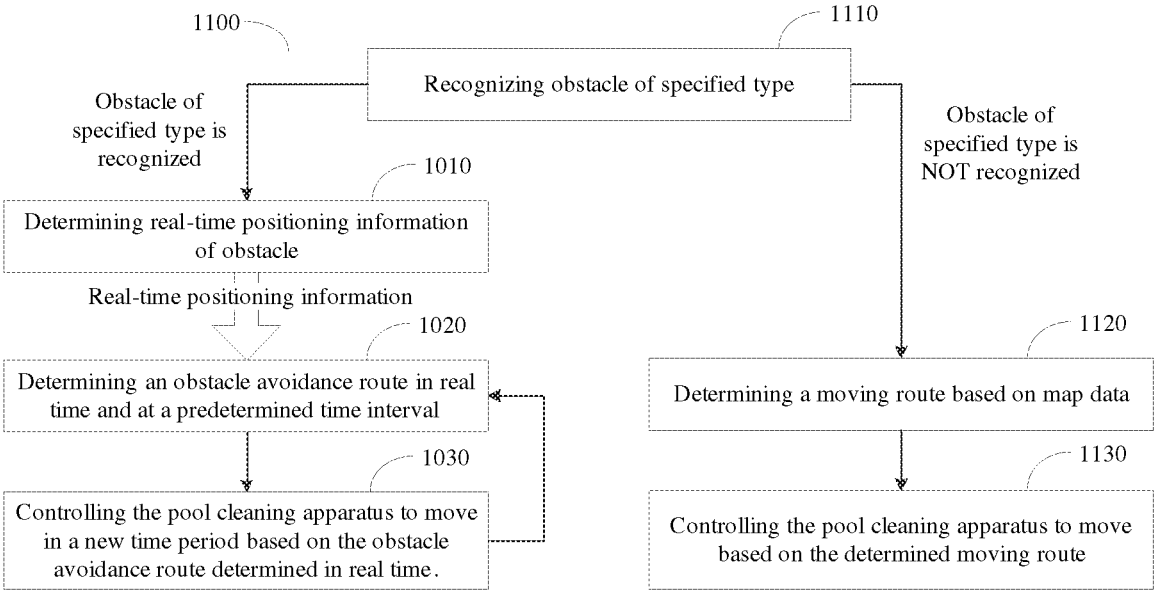
FIG. 11 shows an example of a method of controlling a pool cleaning apparatus in an embodiment.

FIG. 11 schematically illustrates an exemplary method 1100 for controlling a pool cleaning apparatus (for example, the pool cleaning apparatus 100, 300 or 900 in the above examples) in an embodiment. The processor or controller (for example, the processor or controller 120, 320 or 920 in the above examples) in the pool cleaning apparatus (for example, the pool cleaning apparatus 100, 300 or 900 in the above examples) may determine and update the obstacle avoidance route in real time by executing this method, and control the movement of the pool cleaning apparatus according to the real-time obstacle avoidance route.

As shown in FIG. 11, in addition to the above steps 1010, 1020 and 1030, the example method 1100 further include steps 1110, 1120 and 1130.

For example, in the step 1110 or at least partially independent of the step 1110, information at least about obstacles in front of the pool cleaning apparatus in the pool may be continuously or periodically sensed (for example, at a predetermined sampling frequency) by at least one sensor of the pool cleaning apparatus (for example, the ultrasonic sensor 210 and/or the image sensor or camera 310 and/or the lidar 910 in the above examples), so as to obtain information about obstacles in front of the pool cleaning apparatus in the pool.

For example, the sensor of the pool cleaning apparatus may acquire real-time sensed data about the obstacles in the pool in front of the pool cleaning apparatus according to its own sampling frequency, and update the acquired real-time sensed data to the memory in the pool cleaning apparatus, wherein the sensed data acquired in the previous sampling may be retained, or may be dropped.

In the step 1110, for example, the processor or controller in the pool cleaning apparatus (for example, the processor or controller 120, 320 or 920 in the above examples) may identify or recognize an obstacle of specified type (for example, an obstacle of wire harness type) based on the latest real-time sensed data about the obstacles in the pool in front of the pool cleaning apparatus, by any suitable method, such as object shape recognition based on ultrasonic ranging and/or echo frequency, and image recognition or laser point cloud image recognition based on convolution neural network and/or deep learning model.

The step 1110 may be executed repeatedly according to the latest real-time sensed data in the memory at a specified frequency or a specified time interval. For example, the execution frequency of the step 1110 may be lower than or equal to the sampling frequency of the sensor, or the execution interval of the step 1110 may be greater than or equal to the sampling time interval of the sensor. For example, the step 1110 may be performed after each sampling or every several times of sampling by the sensor, or the time interval for performing the step 1110 may be greater than or equal to the sampling time interval of the sensor, without requiring a specific proportional relationship and/or synchronous relationship with the sampling time interval of the sensor.

In a case where an obstacle of specified type is identified or recognized in the step 1110, an execution of the method 1000 may be triggered.

In a case where the obstacle of specified type is not recognized in the step 1110, the method 1100 may proceed to the step 1120 to determine a moving route of the pool cleaning apparatus in the pool according to the map data about at least a part of the pool, and then in the step 1130, control the pool cleaning apparatus to move in the pool based on the moving route determined in the step 1120.

During or after the execution of the step 1030, in a case where the obstacle of specified type is not identified in the step 1110 (for example, the specified type of obstacle is removed from the pool halfway), the execution of method 1000 may be stopped or suspended, and the step 1120 may be started.

During the execution of the step 1130, in a case where an obstacle of a specified type is identified in the step 1110, the execution of the step 1130 may be stopped or suspended, and the method 1000 may be started.

In addition, in the step 1120, the determined moving route may be stored in the memory. Thus, at a next execution of the step 1120, for example in a case where the map data about the pool is not updated, the previously stored moving route may be directly read from the memory in the new round of the step 1120, and in the step 1130, the movement of the pool cleaning apparatus may be controlled according to the read moving route.

By updating the moving route in real time according to the real-time identification result for the specified type of obstacle, a more accurate moving route may be determined by more accurate real-time sensed data as much as possible, so that a better route may be provided and the cleaning coverage of the pool cleaning apparatus may be improved.

Figure 12:
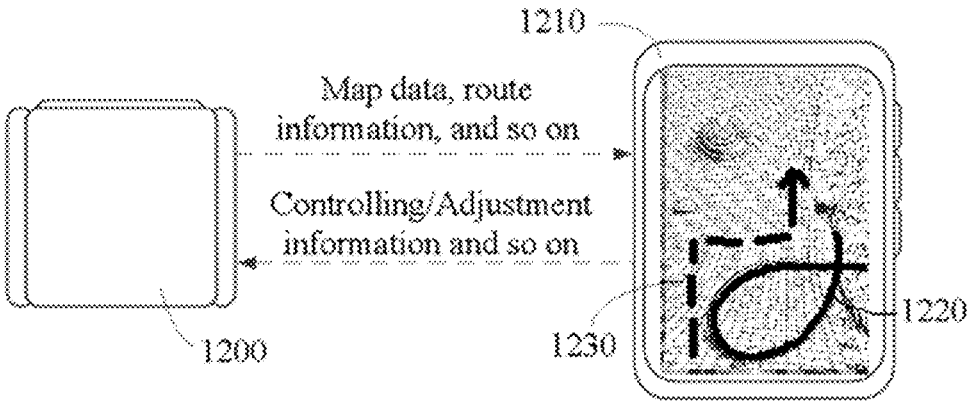
FIG. 12 shows an example of interactions between a pool cleaning apparatus and its control terminal in an embodiment.

In another embodiment, as shown in FIG. 12, a pool cleaning apparatus 1200 (which may be, for example, the pool cleaning apparatus 100, 300 or 900 capable of executing the method 1000 or 1100 described above) may be configured to communicate with a remote-control terminal 1210. For example, the pool cleaning apparatus 1200 may transmit, to the remote-control terminal 1210, one or more information items such as the acquired and/or determined map data about the pool, the image data or point cloud data about the scene in front of the pool cleaning apparatus 1200, and the moving route.

In various embodiments, the remote-control terminal 1210 may include, but is not limited to, a smart phone, a personal computer, a tablet computer, a notebook computer or a server (for example, a cloud server) connected to the pool cleaning apparatus 1200 in a wired and/or wireless manner.

As shown in FIG. 12, on the remote control terminal 1210, information about the scene in front of the pool cleaning apparatus 1200 and/or the planned moving route may be prompted to the user based on data from the pool cleaning apparatus 1200 and in any suitable way such as images, graphics, words and voice, so that the user of the pool cleaning apparatus 1200 may monitor the scene in front of the pool cleaning apparatus 1200, a mark 1220 of the specified type of obstacle and/or the route 1230 determined by the above method in real time on the screen of the remote control terminal 1210, and may control the pool cleaning apparatus 1200 through buttons, keys, touch screens and the like of the remote control terminal 1210. For example, the user of the pool cleaning apparatus 1200 may adjust the route 1230 through an operation on the touch screen of the remote-control terminal 1210.

Then, the remote-control terminal 1210 may transmit control/adjustment information about the pool cleaning apparatus 1200 and/or the route 1230 to the pool cleaning apparatus 1200.

The processor or controller (for example, the processor or controller 120, 320 or 920 in the above examples) of the pool cleaning apparatus 1200 may adjust the route for controlling the movement of the pool cleaning apparatus 1200 and/or perform other control on the pool cleaning apparatus 1200 according to the control/adjustment information received from the remote-control terminal 1210.

The basic principles of the present disclosure have been described above in connection with the embodiments. However, it is appreciated that the advantages, benefits, effects, and so on, which have been mentioned herein, are only examples rather than limitations, and these advantages, benefits, effects, and so on should not be considered as necessary for each embodiment of this disclosure. In addition, the foregoing details are only for the purpose of illustration and easy understanding, rather than limitations, and the foregoing details do not limit that the present disclosure must be implemented with the foregoing details.

The block diagrams of devices, apparatuses, equipment and systems involved in this disclosure are only illustrative examples and are not intended to require or imply that they must be connected, arranged or configured in the manners shown in the block diagrams. In different embodiments, these devices, apparatuses, equipment and systems may be connected, arranged or configured in any suitable manners.

In addition, wordings such as "including", "comprising" and "having" are open words, which mean and is interchangeable with the wording "including but not limited to". The wordings "or" and "and" herein refer to and may be interchangeable with "and/or" unless the context clearly indicates otherwise. The wording "such as" herein refers to and may be interchangeable with the phrase "such as but not limited to".

It is appreciated that in the apparatuses, equipment and methods of the present disclosure, each component or step may be decomposed and/or recombined. Any decomposition and/or recombination should be regarded as equivalents of the present disclosure.

In this disclosure, modifiers without quantifiers such as "first" and "second" are intended to distinguish different elements/components/circuits/modules/apparatuses/steps, and are not used to emphasize an order, positional relationship, importance, priority level, or the like. Sometimes, modifiers with quantifiers such as "first piece of" and "second piece of" may be used to emphasize the order, positional relationship, importance, priority level and so on for different components/components/circuits/modules/apparatuses/steps.

The foregoing description has been presented for purposes of illustration and description. This description is not intended to limit the embodiments of the present disclosure to the forms disclosed herein. Although several example aspects and embodiments have been described above, those skilled in the art may recognize some variations, modifications, changes, additions and sub-combinations thereof.

What is claimed is:

1. A control method for a pool cleaning apparatus, the control method comprising:

determining real-time positioning information of a wire harness obstacle in a pool based on real-time sensed data about obstacles in front of the pool cleaning apparatus in the pool;

determining, in real time and at a predetermined time interval, an obstacle avoidance route allowing the pool cleaning apparatus to bypass the wire harness obstacle, based on the real-time positioning information of the wire harness obstacle in the pool and map data about at least a part of the pool; and controlling a moving mechanism of the pool cleaning apparatus to move the pool cleaning apparatus in the pool in a new time period with a duration corresponding to the predetermined time interval, based on the obstacle avoidance route determined in real time.

2. The control method of claim 1 wherein the predetermined time interval is greater than or equal to 50 milliseconds and is less than or equal to 300 milliseconds.

3. The control method of claim 1 wherein the obstacle avoidance route further depends on a height of the pool cleaning apparatus.

4. The control method of claim 1 further comprising:

updating the real-time positioning information of the wire harness obstacle in the pool into the map data.

5. The control method of claim 1 wherein at least a part of the obstacle avoidance route is along an edge of a shape of the wire harness obstacle or an edge of a bounding box of the wire harness obstacle.

6. The control method of claim 1 further comprising:

obtaining the real-time sensed data through at least one lidar and/or at least one camera of the pool cleaning apparatus.

7. The control method of claim 1 further comprising:

recognizing the wire harness obstacle among the obstacles according to the real-time sensed data.

8. The control method of claim 7 further comprising:

determining a moving route of the pool cleaning apparatus in the pool based on map data about at least a part of the pool, in the case of a failed detection of the wire harness obstacle according to the real-time sensed data; and controlling the moving mechanism to operate, to enable the pool cleaning apparatus to move in the pool based on the determined moving route.

9. The control method of claim 2 further comprising:

recognizing the wire harness obstacle among the obstacles according to the real-time sensed data.

10. The control method of claim 9 further comprising:

determining a moving route of the pool cleaning apparatus in the pool based on map data about at least a part of the pool, in the case of a failed detection of the wire harness obstacle according to the real-time sensed data; and controlling the moving mechanism to operate, to enable the pool cleaning apparatus to move in the pool based on the determined moving route.

11. A pool cleaning apparatus comprising:

a moving mechanism;

at least one sensor configured to obtain real-time sensed data about obstacles in front of the pool cleaning apparatus in a pool; and a controller configured to determine real-time positioning information of a wire harness obstacle in a pool based on the real-time sensed data about obstacles in front of the pool cleaning apparatus in the pool, determine, in real time and at a predetermined time interval, an obstacle avoidance route allowing the pool cleaning apparatus to bypass the wire harness obstacle, based on the real-time positioning information of the wire harness obstacle in the pool and map data about at least a part of the pool, and control the moving mechanism to move the pool cleaning apparatus in the pool in a new time period with a duration corresponding to the predetermined time interval, based on the obstacle avoidance route determined in real time.

12. The pool cleaning apparatus of claim 11 wherein the at least one sensor comprises at least one lidar and/or at least one camera.

13. The pool cleaning apparatus of claim 11 wherein the predetermined time interval is greater than or equal to 50 milliseconds and is less than or equal to 300 milliseconds.

14. The pool cleaning apparatus of claim 11 wherein the obstacle avoidance route further depends on a height of the pool cleaning apparatus.

15. The pool cleaning apparatus of claim 11 wherein the controller is further configured to update the real-time positioning information of the wire harness obstacle in the pool into the map data.

16. The pool cleaning apparatus of claim 11 wherein at least a part of the obstacle avoidance route is along an edge of a shape of the wire harness obstacle or an edge of a bounding box of the wire harness obstacle.

17. The pool cleaning apparatus of claim 11 wherein the controller is further configured to obtain the real-time sensed data through at least one lidar and/or at least one camera of the pool cleaning apparatus.

18. The pool cleaning apparatus of claim 11 wherein the controller is further configured to recognize the wire harness obstacle among the obstacles according to the real-time sensed data.

19. The pool cleaning apparatus of claim 18 wherein the controller is further configured to determine a moving route of the pool cleaning apparatus in the pool based on map data about at least a part of the pool, in the case of a failed detection of the wire harness obstacle according to the real-time sensed data.

* * * * *